141-114 10 SR

10/22/85 OR 4,548,243

United States Patent [19]

Diaz

[11] Patent Number: 4,548,243

[45] Date of Patent: Oct. 22, 1985

[54] APPARATUS FOR AUTOMATICALLY PLACING BAGS

[75] Inventor: Jose A. Diaz, Tampa, Fla.

[73] Assignee: General Portland, Inc., Dallas, Tex.

[21] Appl. No.: 548,681

[22] Filed: Nov. 4, 1983

[51] Int. Cl.[4] ..... B65B 3/17

[52] U.S. Cl. ..... 141/114; 141/10; 141/166; 53/384; 53/473

[58] Field of Search ..... 141/10, 68, 98, 114, 141/166, 313–317, 271, 283; 53/459, 469, 473, 168, 202, 384, 386, 370, 371, 373; 221/211; 186/66, 59

[56] References Cited

U.S. PATENT DOCUMENTS

| | | | |
|---|---|---|---|
| 3,691,715 | 9/1972 | Kelly et al. | 53/459 |
| 3,715,858 | 2/1973 | Durant et al. | 53/386 X |
| 3,785,414 | 1/1974 | Obara | 141/114 |
| 3,952,479 | 4/1976 | Achelpohl | 141/166 X |
| 4,128,116 | 12/1978 | Uthoff et al. | 141/114 X |
| 4,141,392 | 2/1979 | Moltrasio | 141/98 |
| 4,211,053 | 7/1980 | Niccolls | 53/386 |
| 4,411,296 | 10/1983 | Durant | 141/98 |

FOREIGN PATENT DOCUMENTS

| | | | |
|---|---|---|---|
| WO81/01543 | 6/1981 | PCT Int'l Appl. | 141/10 |

*Primary Examiner*—Stephen Marcus
*Assistant Examiner*—Ernest G. Cusick
*Attorney, Agent, or Firm*—Frijouf, Rust & Pyle

[57] ABSTRACT

An apparatus is disclosed for automatically placing valve vented bags on a filling spout. The apparatus includes a first table disposed adjacent a bag conveyor for sequentially receiving individual bags from the conveyor. A first bag clamp is disposed adjacent the first table for sequentially clamping the bags against the table. A first retractable suction cup device cooperates with the bags for opening the valve vent of clamped bags. A first bag gripper is located on a first carriage supported and guided by a first pair of rails. The first pair of rails are pivotally mounted such that the first carriage is alternately guided to a plurality of filling spouts. The gripper grips the open valve vented bag and transfers the open bag to one of the plural filling spouts.

27 Claims, 30 Drawing Figures

APPARATUS FOR AUTOMATICALLY PLACING BAGS

BACKGROUND OF THE INVENTION

1. Field of the Invention

This invention relates to an apparatus for automatically placing valve vented bags on a filling spout of a packaging machine. More particularly, the invention relates to an apparatus for automatically opening valve vented bags, for transferring the opened bags from a bag conveyor, and for placing the opened bags alternately on plural filling spouts of a packaging machine or the like.

2. Information Disclosure Statement

Traditionally, the filling and closing of bags containing powdery or granular material has been accomplished by pouring the material into the bag and sewing the top edge of the bag to provide a spill-proof seal to the package. With the advent of valve vented bags, the speed with which bags can be filled and sealed has been greatly increased. The valve vented bag is a bag usually fabricated from a sheet of relatively thick paper and having the top seam folded in such a way that a flap valve is integrally provided in the top of the bag. When the opened flap valve is placed over a filling spout of a packaging machine or silo, the material to be packaged is fed directly into the bag. When the bag has been filled, the bag is slipped off the filling spout and the flap valve automatically seals the bag against spillage by virtue of the internal pressure exerted on the flap valve by the contents of the bag.

In the cement packaging art, the majority of packaging machines include a row of four filling spouts. Filling of bags has been carried out manually by having an operator remove bags, one at a time, from a stack of bags and placing the bags, one at a time, onn the filling spouts. Although the filled bags sometimes disengage from the filling spout when full, as often as not it becomes necessary to manually pull the filled bag off the spilling spout. Obviously, the aforementioned manual packaging process is time consuming and costly. Additionally, in view of the environment encountered in the vicinity of the filling spouts, face masks and eye protective equipment must be worn by the operator. In addition, the speed with which bags can be filled is very limited and an experienced bag placer will find difficulty in maintaining a speed of twenty or more bags per minute for any extended period.

In view of the aforementioned problems related to the bag placing art, several proposals have been made in an attempt to fully automate the packaging of powdery or granular materials. One such proposal is that known in the art as the ROTO-PACKER (registered trademark) produced by Haver & Boecker. The ROTO-PACKER replaces the conventional packaging machine by a rotary type packaging machine having radially extending filling spouts. A reel or roll of 2,000 to 3,000 bags feeds a shingled row of bags to the bag placing mechanism which transfers the bags, one at a time, to one of the filling spouts as the filling spouts rotate into a bag placing station. Such automatic bag placers have greatly increased the overall speed with which bags can be placed and filled. Operating speeds of 33–36 bags per minute are possible. However, although the automatic bag placer of U.S. Pat. No. 3,138,217 assigned by Haver & Boecker provides a high speed packaging machine, the cost of removing an existing packaging machine and replacing the same with a ROTO-PACKER could probably reach $500,000 per installation. Such high installation costs can rarely be justified relative an existing packaging plant, and a need has existed in the art of an automatic bag placer which will operate to place opened bags on the row of filling spouts of a conventional packaging machine.

U.S. Pat. No. 3,715,858 to Durant et al discloses an automatic bag placer for placing the opened bags on the filling spouts of a conventional packaging machine. However, the bags are fed from a stack of bags. Such a stack of bags would only run for approximately one-half hour and would therefore require an operator to be employed full time to provide a constant supply of bags.

The automatic bag placer of the present invention overcomes the aforementioned inadequacies of the prior art devices by providing an automatic bag placer for use with a conventional packaging machine, the bag placer being fed with bags supplied from a roll of such bags. A bag placer according to the present invention has successfully operated at a speed of 20 bags per minute when installed for use with a conventional packaging machine having four filling spouts in a row. It is the primary object of the present invention to provide a relatively low cost apparatus which can be installed for operation with a conventional packaging machine having filling spouts in a row.

Another object of the present invention is the provision of an automatic bag placer in which the bags are fed to the bag placing mechanism from a roll or reel of valve vented bags.

Another object of the present invention is the provision of a first suction cup which is retractable relative the path of the bags being fed towards the bag placing mechanism.

Another object of the present invention is the provision of a first bag gripper having a pair of jaws which grip the open bag when the bag is held in the open position by the suction cup device.

Another object of the present invention is the provision of a first bag gripper which moves from a tilted disposition when gripping the open bag held by the suction cup device to a dependent disposition when transferring the open bag towards the filling spout.

Another object of the present invention is the provision of a first bag gripper which rotates through a one-quarter revolution when in a dependent disposition such that the open bag is aligned for the entry therein of the filing spout.

Another object of the present invention is the provision of a first carriage for rotatably supporting the first bag gripper.

Another object of the present invention is the provision of a first pair of rails for supporting and guiding the carriage between the first table and the filling spout.

Another object of the present invention is the provision of a pair of rails pivotably mounted relative to the bag placer frame such that the first carriage is alternately guided towards a first filling spout and then a second filling spout.

Another object of the present invention is the provision of a first and a second bag conveyor, a first and a second roll of valve vented bags, a first and a second table, a first and a second bag clamp, a first and a second suction cup device, a first and a second bag gripper, a first and a second carriage, a first pair of rails for guiding the first carriage alternately towards a first and a second filling spout of a packaging machine, and a second pair of rails for guiding the second carriage alternately towards a third and a fourth filling spout of the packaging machine.

Another objective of the present invention is the provision of an automatic bag placer in which the bag clamps, the suction cups, the bag gripper, the bag carriage and the rails are moved by pneumatic means.

Another objective of the present invention is the provision of a computerized control circuit for regulating the operation of the pneumatic rams.

The foregoing has outlined some of the more pertinent objects of the present invention. These objects should be construed to be merely illustrative of some of the more prominent features and applications of the invention. Many other beneficial results can be attained by applying the disclosed invention in a different manner or modifying the invention within the scope of the invention. Accordingly, other objects and a fuller understanding of the invention may be had by referring to the summary of the invention and the detailed description describing the preferred embodiment in addition to the scope of the invention defined by the claims taken in conjunction with the accompanying drawings. This should not be construed as limited to bag placers for use with cement packaging machines but should include bag placers for packaging machines for packaging any powder or granular material or the like into bags and should not be limited to packaging machines having four filling spouts.

SUMMARY OF THE INVENTION

The automatic bag placer of the present invention is defined by the appended claims with a specific embodiment shown in the attached drawings. For the purpose of summarizing the invention, the invention relates to an apparatus for automatically opening valve vented bags and for transferring the opened bags from a bag conveyor and for placing the opened bags sequentially on filling spouts of a packaging machine or the like. The automatic bag placer includes a first table disposed adjacent the bag conveyor for sequentially receiving the bags from the conveyor. A first bag clamp is disposed adjacent the first table for sequentially clamping the bags adjacent the first table. A first retractable suction cup cooperates with the valve vented bags for opening the clamped bags and a first bag gripper grips the opened bags as they are held by the suction cup. A first carriage rotatably supports the bag gripper and a first pair of rails supports and guides the first carriage. The first pair of rails is pivotally mounted such that the first carriage is sequentially guided towards a plurality of filling spouts.

In a more specific embodiment of the present invention, an automatic bag placer includes a framework and a first and a second bag conveyor, each conveyor having a first and a second end. The first ends of the conveyors are mounted relative the framework and a first and a second roll of valve vented bags are supported respectively adjacent the second ends of the bag conveyors. First and second counterweighted pulleys cooperate respectively with the second ends of the bag conveyors for counteracting respectively the weights of the first roll and first bag conveyor and the second roll and the second bag conveyor. A first and a second table are disposed respectively adjacent the first ends of the first and the second bag conveyors. A first and a second bag clamp are disposed respectively adjacent the first and the second table for sequentially clamping the bags against the table. A first and a second retractable suction cup cooperates with the valve vented bags of the first and the second rolls, respectively, for opening the clamped bags. Each of the suction cups moves sequentially from a first position in which each of the suction cups is retracted relative the respective tables to a second position in which each of the suction cups is disposed adjacent a respective clamped bag to a third position in which each of the suction cups is connected to a source of partial vacuum and contacts each of the clamped bags adjacent each of the valves of each of the bags to a fourth position in which each of the suctions cups returns to the second position while connected to the source of pressure. A first and a second bag gripper grips the opened bag while held in the fourth position by the first and second suction cups, respectively. A first and a second carriage rotatably supports the first and the second bag gripper, respectively, and a first and a second pair of rails supports and guides the first and second carriages, respectively, the first and second pair of rails each being pivotally mounted relative the framework such that the first carriage is sequentially guided to a first plurality of filling spouts and the second carriage is sequentially guided to a second plurality of filling spouts.

The presence of bags on the first and the second tables is detected by bag sensors and the clamps, suctions cups, bag grippers, carriages and rails are moved by rams. The retractable suction means each include a first rotatably mounted rod and a first arm pivotally mounted to one end of the first rod. A first primary bracket is rigidly secured to the first arm, the first primary bracket being disposed in a plane substantially perpendicular to the plane of the first arm. A first secondary bracket is rigidly secured to the first arm remote from the first rod and the first primary bracket. The first secondary bracket is disposed in a plane substantially perpendicular to and tilted relative to the plane of the first arm. A first radius arm is rigidly secured to the first rod. A first primary suction means ram is pivotally connected to and extends between the first radius arm and the first primary bracket. A first secondary suction means ram is pivotally connected to the first rod for rotating the first rod about the axis thereof and a first suction cup is rigidly secured adjacent the first secondary bracket such that the combined operation of the primary and secondary suction means rams causes, respectively, pivoting of the first arm relative the first rod and rotation of the first rod to advance the first suction cup towards the first table means.

The bag gripper includes a shaft rotatably secured relative the carriage means, the shaft having a first and a second end. An extension is pivotally connected to the first end of the shaft. A gripping means first ram extends between and is pivotally connected to the shaft and the extension, respectively. A pair of gripping tongs is pivotally connected to the extension and disposed remote from the shaft. A gripping means second and third ram extends between and is pivotally connected to the extension and the pair of gripping tongs, the second and the third rams being disposed on opposite sides of the extension, and the gripping means fourth ram extends between and is pivotally secured to the carriage means and the rotatable shaft for rotating the gripping means relative the carriage means.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Figure 7:
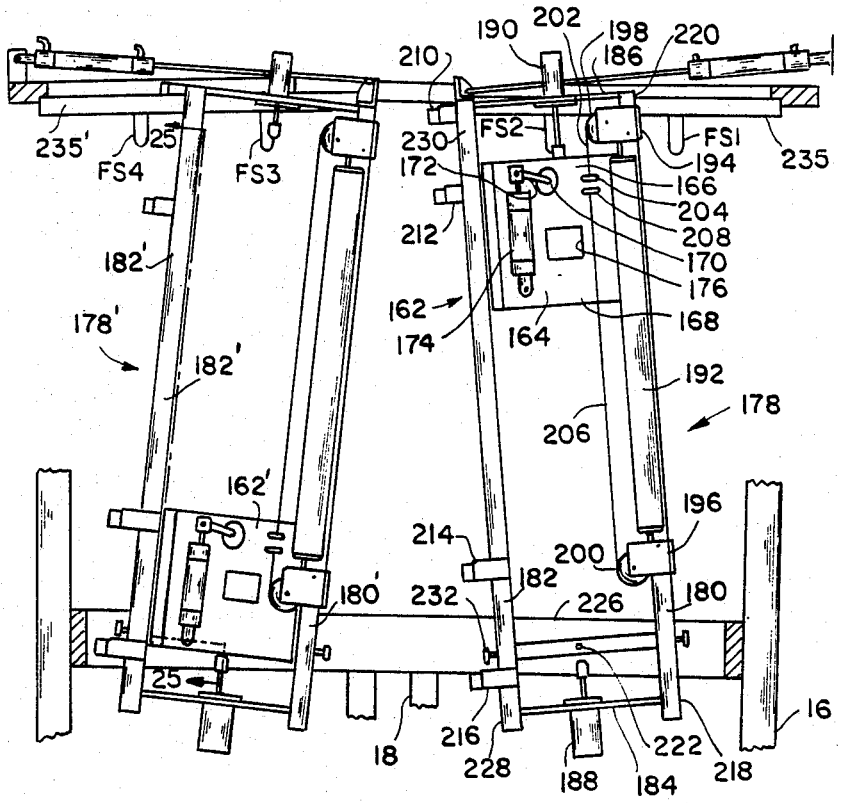
FIG. 7 is a top plan view of the automatic bag placer of FIG. 6 showing the first pair of rails disposed in the second location for guiding the first carriage to the second filling spout and the second pair of rails disposed in the first location for guiding the second carriage to the third filling spout.
Figure 8:
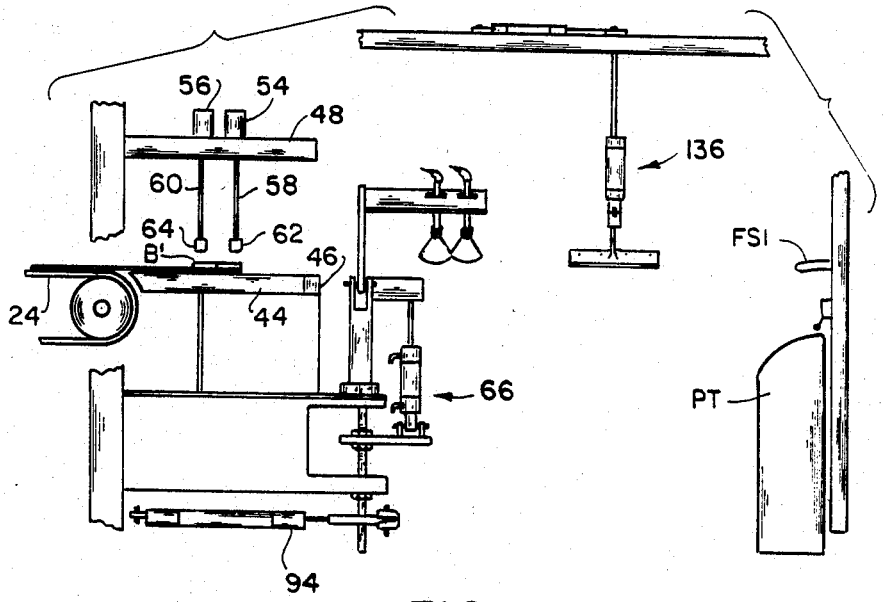
FIG. 8 is a side elevational view of the automatic bag placer of the present invention with the bag being conveyed onto the table means, the clamp means in the raised position, the suction means in the first position and the carriage means returning towards the table.
Figure 14:
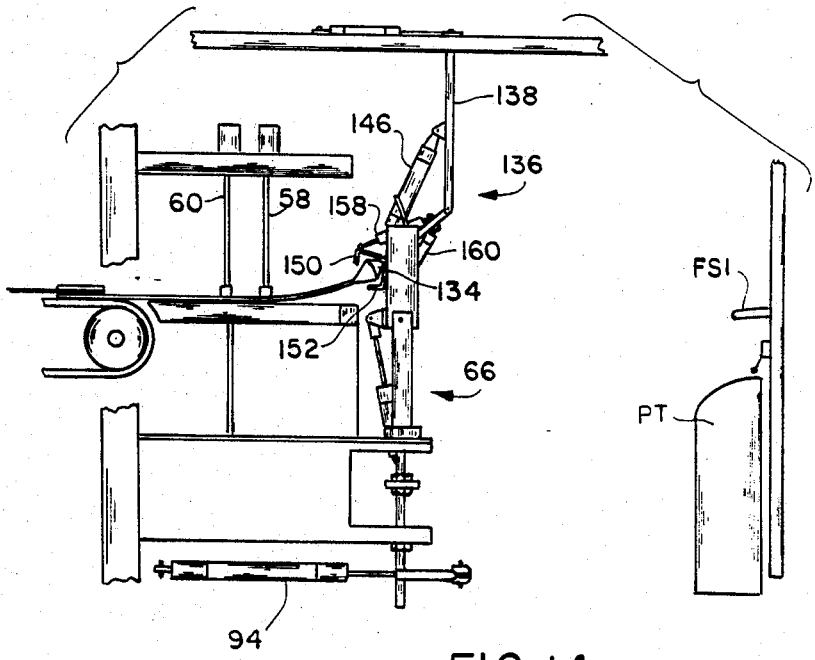
Figure 15:
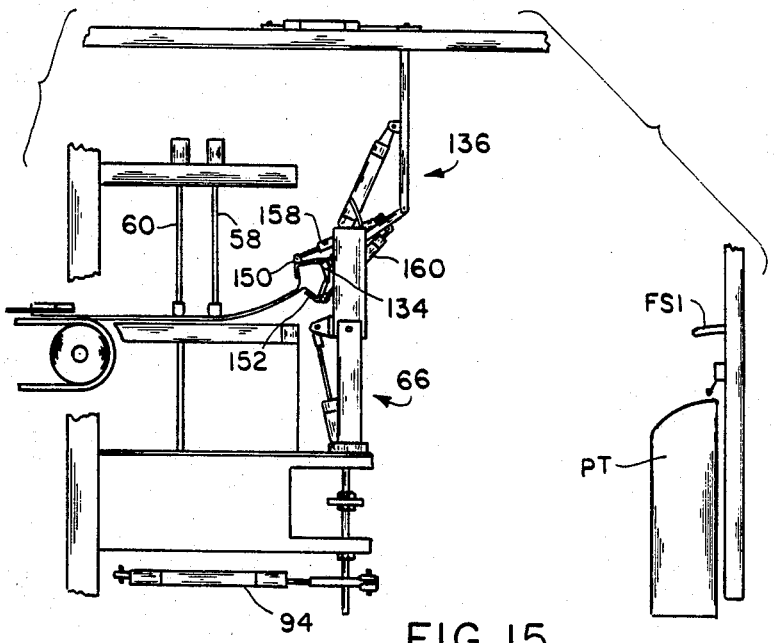
Figure 16:
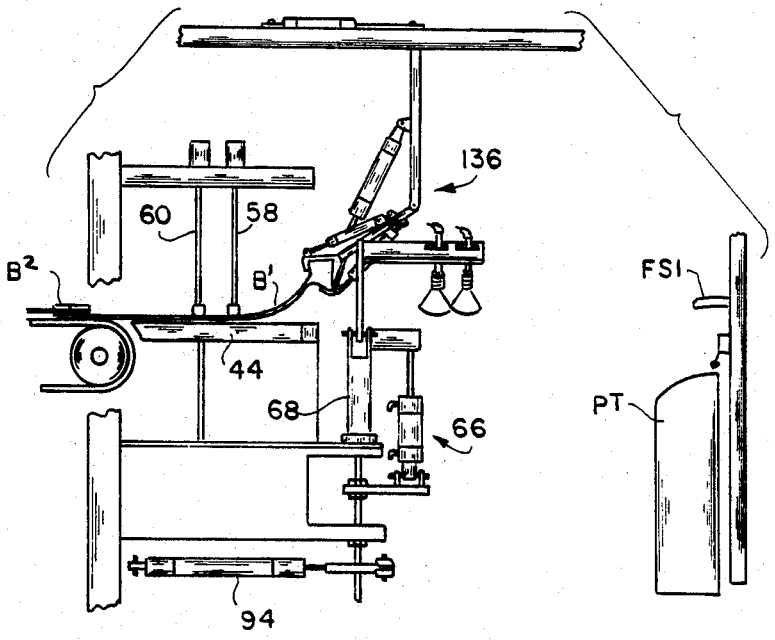
Figure 17:
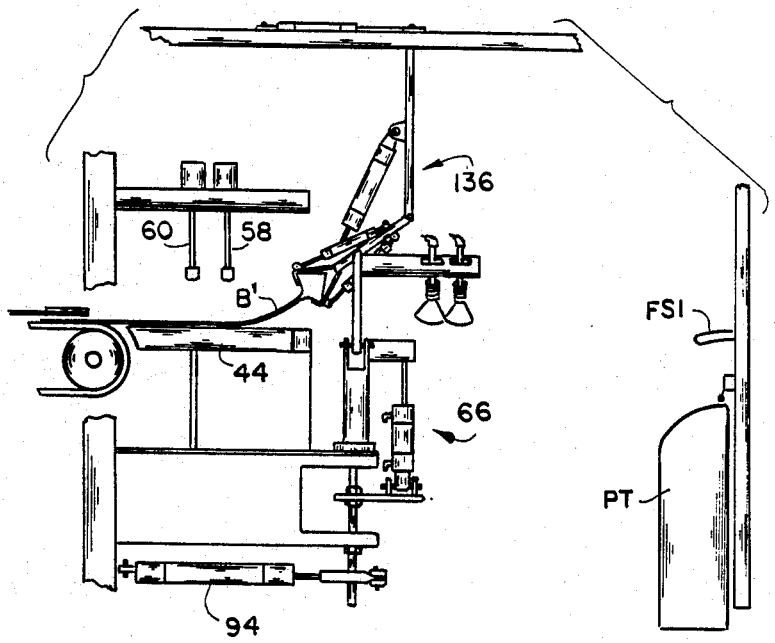
Figure 18:
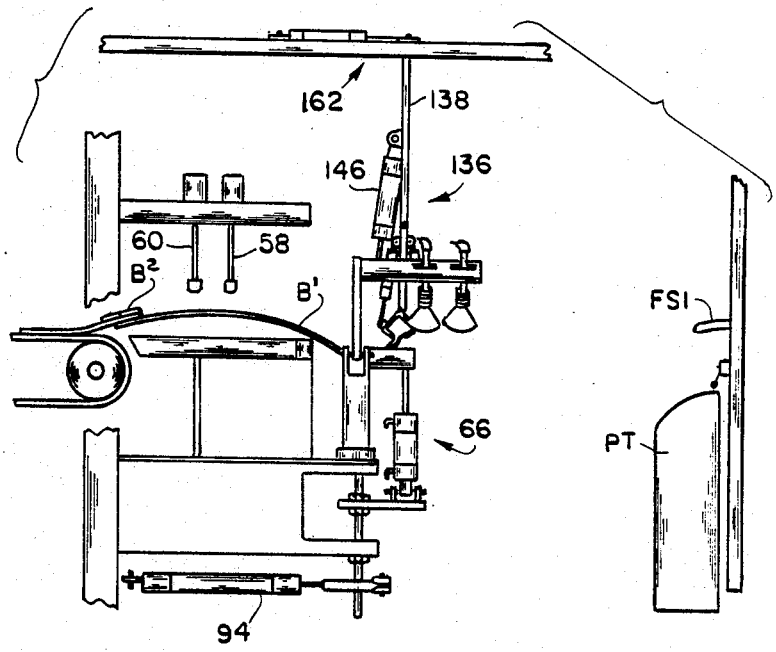
Figure 19:
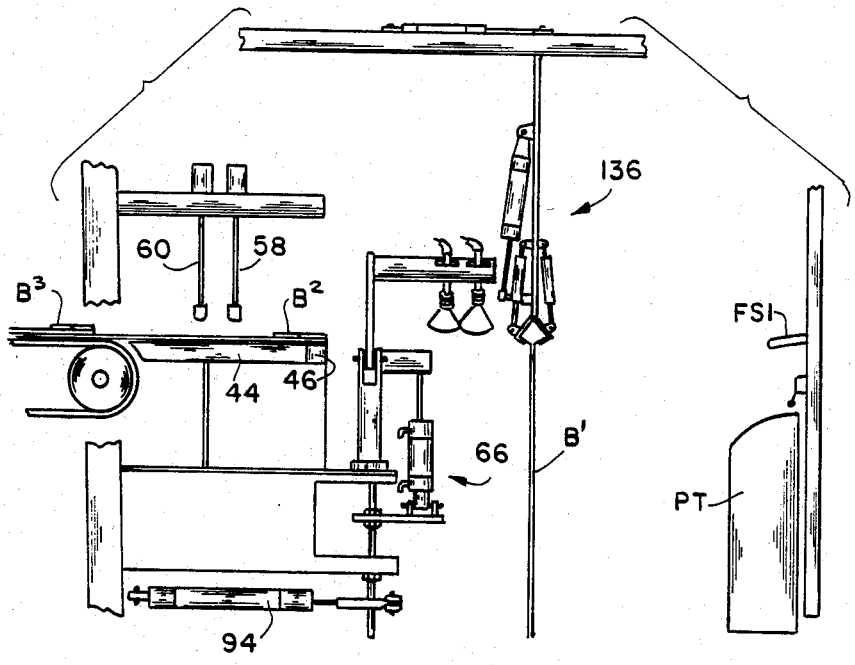
Figure 20:
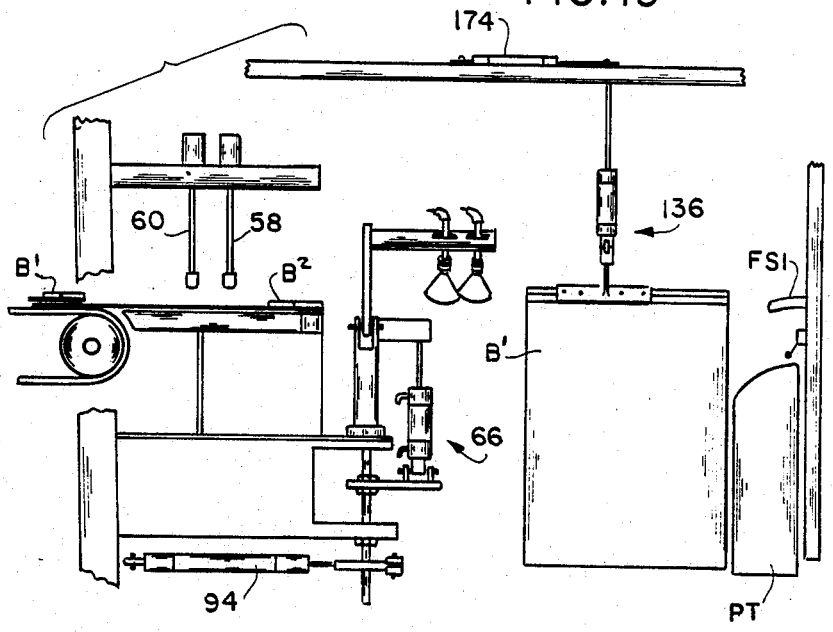
Figure 21:
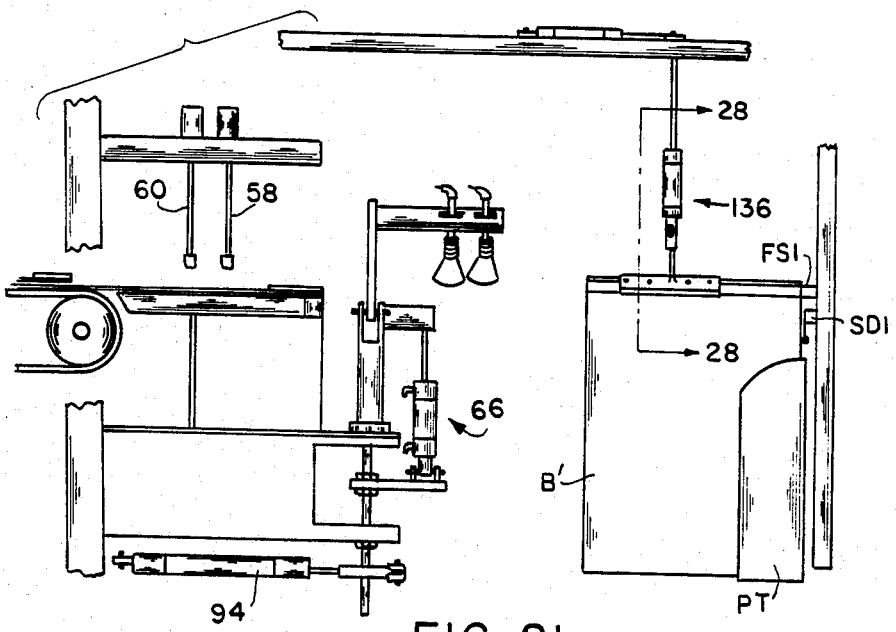
Figure 22:
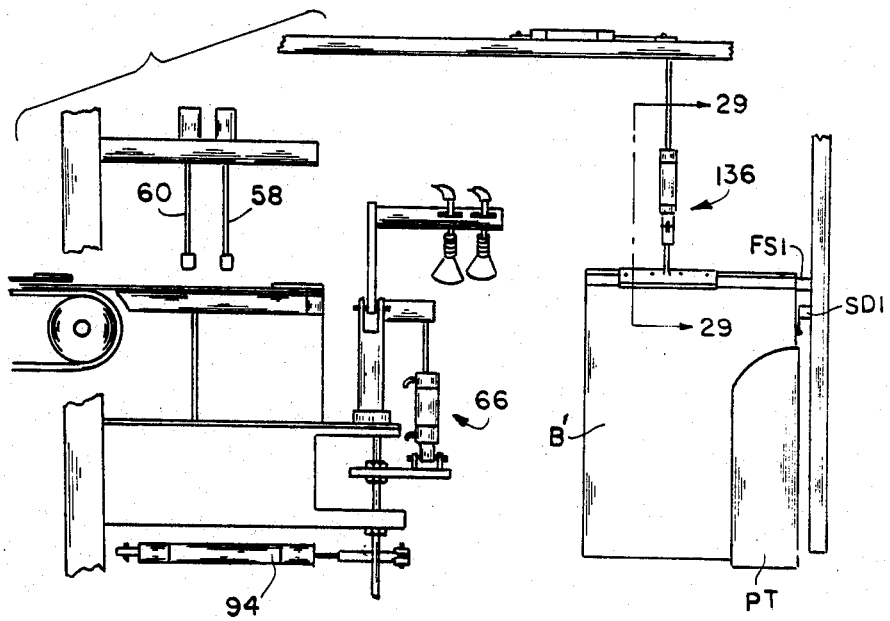
Figure 23:
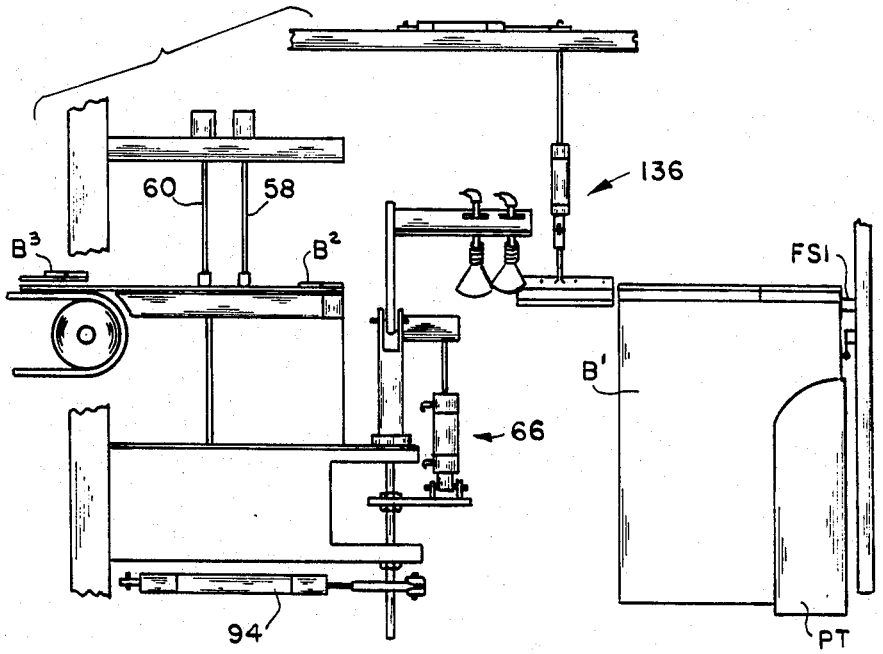
Figure 24:
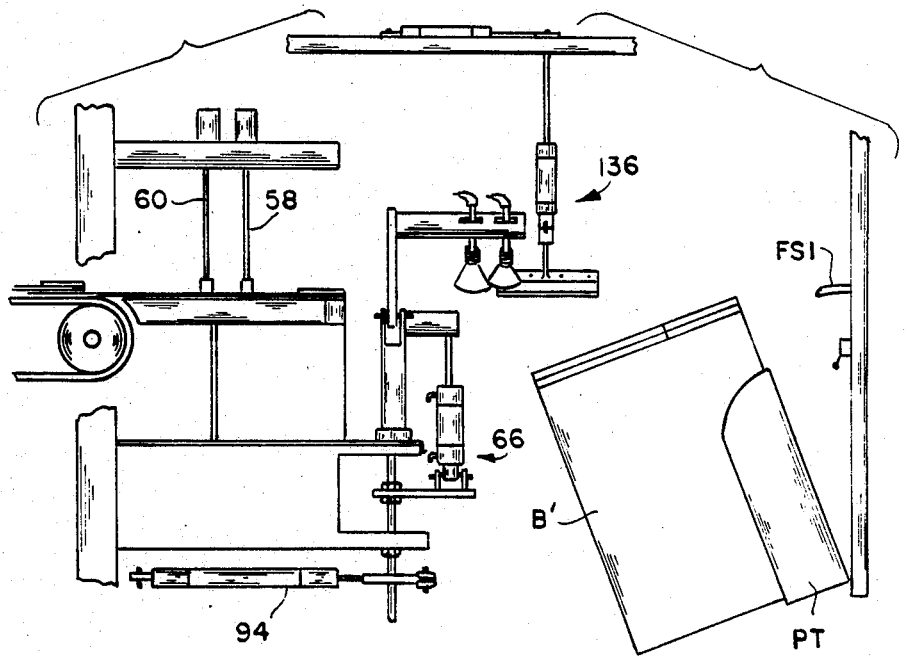
Figure 29:
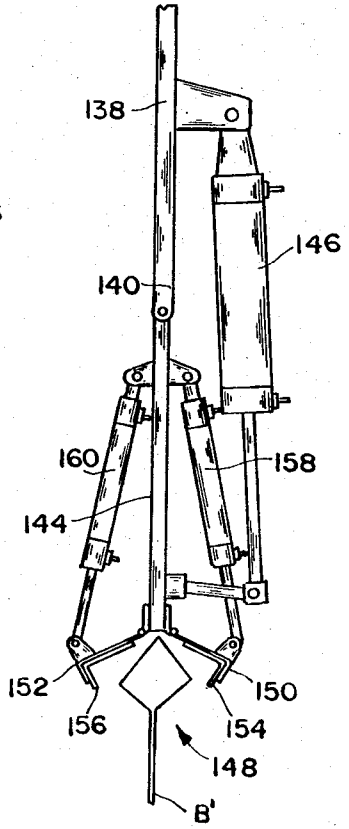
Figure 28:
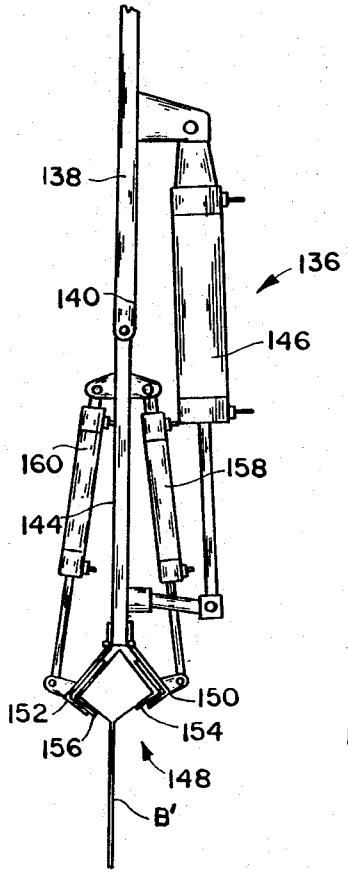
Figure 25:
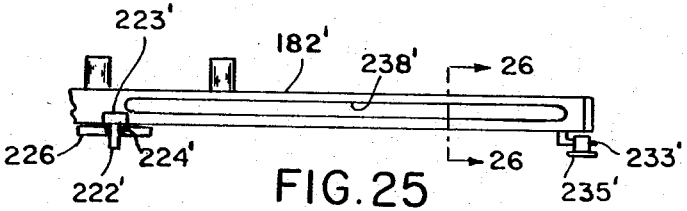
Figure 27:
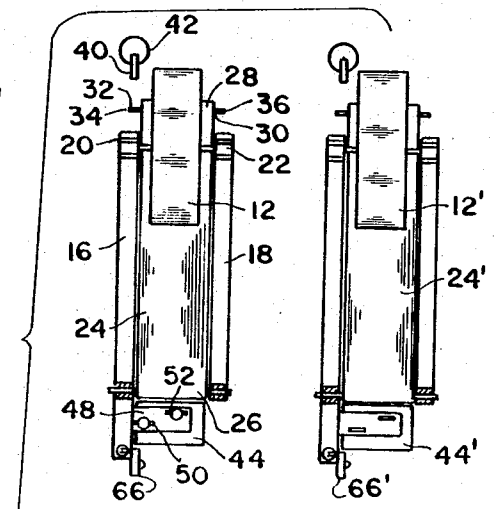
Figure 26:
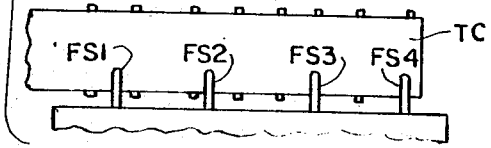
Figure 26:
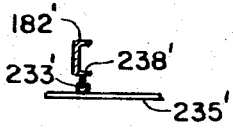

FIG,. 13 is a similar view to that shown in FIG. 8 but shows the first arm of the suction means having pivoted back to the fourth position which is the same as the second position thereof. The suction cup is shown opening the valve vented bag with the gripping means having rotated one-quarter revolution;

FIG. 14 is a similar view to that shown in FIG. 8 but shows the extension of the gripping means tilted angularly relative the gripping means shaft and the jaws opened to encircle the open bag held by the suction cup;

FIG. 15 is a similar view to that shown in FIG. 8 but shows the jaws having closed around the open bag;

FIG. 16 is a similar view to that shown in FIG. 8 but shows the suction means having rotated to the first position thereof retracted from the path of the bags being transferred;

FIG. 17 is a similar view to that shown in FIG. 8 but shows the bag clamping means in the raised position to release the opened bag which is gripped by the closed jaws;

FIG. 18 is a similar view to that shown in FIG. 8 but shows the extension of the gripping means restored to a depending disposition having the same longitudinal access as the shaft of the gripping means;

FIG. 19 is a similar view to that shown in FIG. 8 but shows the bag as having been pulled clear of the table and depending from the jaws of the gripping means;

FIG. 20 is a similar view to that shown in FIG. 8 but shows the shaft of the gripping means having been rotated back a one-quarter revolution in order to align the open bag with a filling spout;

FIG. 21 is a similar view to that shown in FIG. 8 but shows the open bag and the filling spout inserted therein, a sensor is shown which senses the presence of the bag;

FIG. 22 is a similar view to that shown in FIG. 8 but shows the jaws of the bag gripper opened to release the bag;

FIG. 23 is a similar view to that shown in FIG. 8 but shows the gripper means returning towards the table and the clamping means clamping the next bag;

FIG. 24 is a similar view to that shown in FIG. 8 but shows the bag having been filled pivoting away from the filling spout;

FIG. 25 is a sectional view taken on the line 25—25 of FIG. 7;

FIG. 26 is a sectional view taken on the line 26—26 of FIG. 25;

FIG. 27 is a top plan view of the first and second rolls, the first and second bag conveyors, the first and second tables, the first and second suction means and the filling spouts of the packaging machine;

FIG. 28 is an enlarged sectional view taken on the line 28—28 of FIG. 21; and FIG. 29 is an enlarged sectional view taken on the line 29—29 of FIG. 22.

Similar reference characters refer to similar parts through the several views of the drawings.

DETAILED DESCRIPTION

Roll and Bag Conveyor

Figure 1:
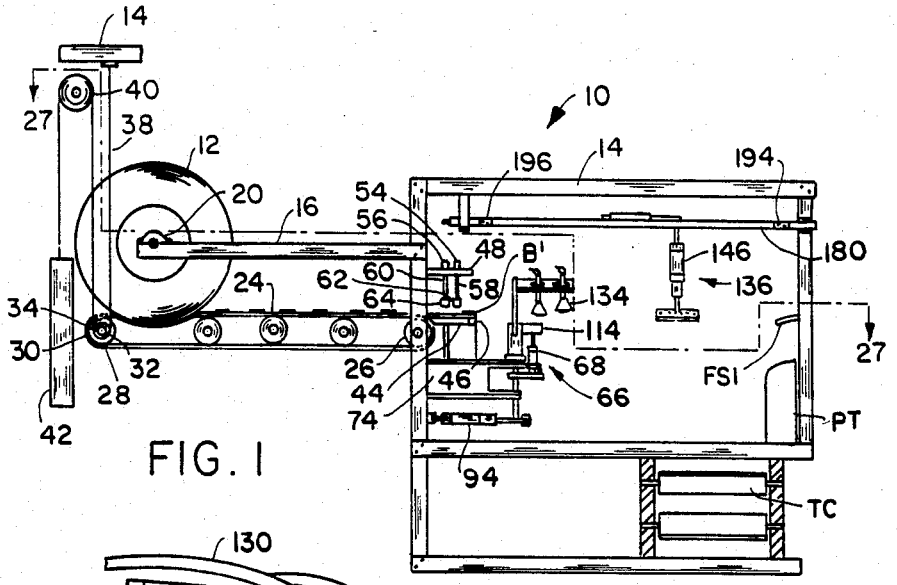
FIG. 1 is a side elevational view of the automatic bag placer of the present invention.

FIG. 1 is a side elevational view of an apparatus for automatically opening valve vented bags and for transferring the opened bags from a bag conveyor for placing the bags sequentially on filling spouts of a packaging machine. The apparatus is generally designated 10 and includes a first reel or roll 12 of valve vented bags. The roll 12 is rotatably mounted on a framework 14. The framework 14 includes a pair of parallel spaced roll support arms 16 and 18, respectively, and the roll 12 is locked on the distal end of the arm 16 and 18 by bearing supports 20 and 22, respectively. A first bag conveyor 24 includes a first and a second end thereof 26 and 28, the conveyor 24 being pivotally mounted on the frame member 14 adjacent the first end 26 of the conveyor. The second end 28 of the conveyor 24 is disposed against the underside of the roll 12. A roller 30 is disposed at the second end 28 of the conveyor 24 includes a central spindle 32. The ends 34 and 36, respectively, of the spindle 32 protrude laterally relative the roller 30 as shown particularly in FIG. 27. A wire 38 anchored to the framework 14 extends downwardly towards one of the protruding ends 34 of the spindle 32 and around the end 34 towards a counterweighted pulley 40 which is suspended from the framework 14. The wire 38 extends around the pulley 40 and downwardly towards counterweight 42 which counteracts the weight of the bag conveyor 24 and presses the same upwardly against the underside of the roll 12. Accordingly, roller 30 is maintained in contact with the periphery of the roll 12 of valve vented bags irrespective of the diameter of the roll.

Table and Bag Clamp

A first table 44 is disposed adjacent the first end 26 of the conveyor 24 and extends generally in the same plane as the top surface of the conveyor 24. The first table 44 is rigidly secured to the framework 14 and includes at least one sensor 46 disposed thereon for sensing the presence of one of the bags B' thereon. A plate 48 is rigidly secured to the framework 14 above and parallel to the plane of the first table 44. The plate 48 defines two slots 50 and 52 as shown in FIG. 27 disposed laterally in the direction of travel of the bags along the conveyor 24. The slots 50 and 52 are disposed parallel and diagonal relative each other to permit accurate positioning of the bag clamps. A first and a second pneumatic rams 54 and 56 are secured to the top surface of the plate 48. A first and a second clamp 58 and 60 depend respectively from the first and second rams 54 and 56 such that the clamping rams 58 and 60 are spaced relative to each other and disposed obliquely relative to the direction in which the bags are fed along the bag conveyor. The clamps 58 and 60 each have a rubber head 62 and 64, respectively, at the distal ends of the clamps 58 and 60. The heads 62 and 64 cooperate with the table 44 upon actuation of the rams 54 and 56. When a bag B' is sensed by the sensor 46, a signal is sent to the rams 54 and 56 to lower the clamps 58 and 60 such that the bag B' is clamped between the heads 62 and 64 and the table 44.

Retractable Suction Cup Device

Figure 2:
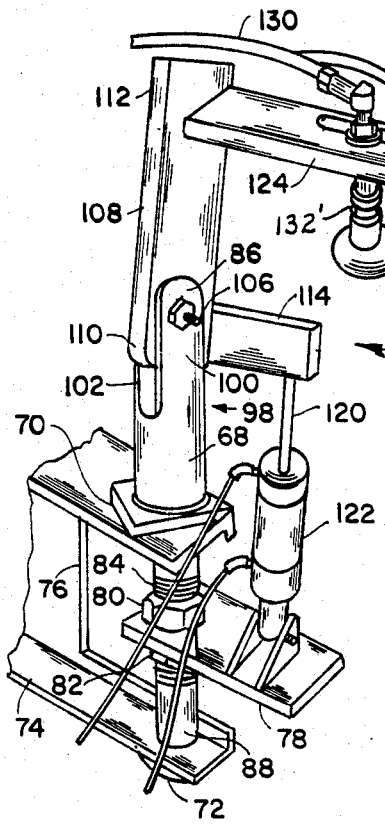
FIG. 2 is an enlarged perspective view of the retractable suction means of the present invention.
Figure 3:
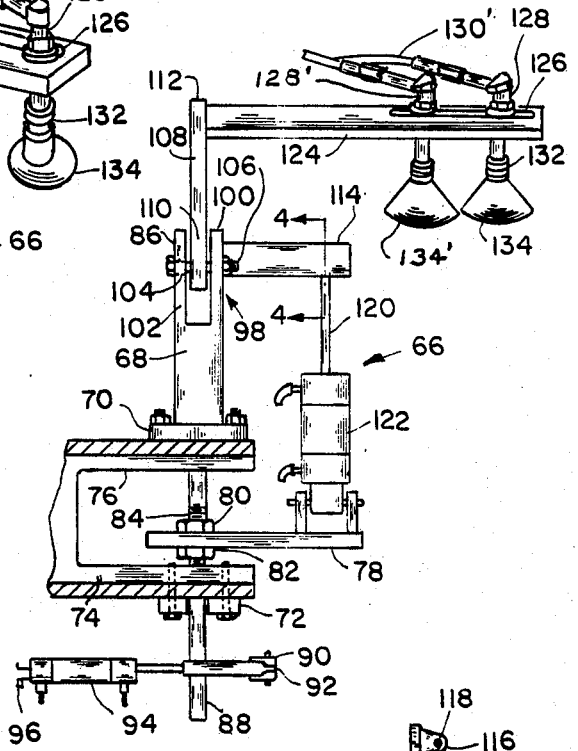
FIG. 3 is a side elevational view of the retractable suction means shown in FIG. 2.
Figure 4:
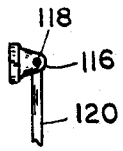
FIG. 4 is a sectional view taken on the line 4—4 of FIG. 3.

A first retractable suction device is generally designated 66. The suction device 66 includes a first rotatably mounted rod 68 shown more particularly with reference to FIGS. 2, 3 and 4. The rod 68 is rotatably mounted within an upper and a lower bearing 70 and 72, respectively. The bearings 70 and 72 are rigidly secured to an extension 74 of the framework 14. The extension 74 is generally of [-shaped cross section with a central portion 76 in the vicinity of the rod 68 cut away to permit rotation therein of a first radius arm 78 rigidly secured to the rod 68 by an upper and a lower nut 80 and 82, respectively, which cooperate with a threaded portion 84 of the rod 68. The rod 68 includes an upper and a lower end 86 and 88, respectively. As shown best in FIG. 3, the lower end 88 of the rod 68 is rigidly connected to a radially extending arm 90 which is pivotally connected to the distal end 92 of a suction cup first pneumatic ram 94. The casing of the first ram 94 is pivotally connected by pin 96 to the framework 14 such that actuation of the ram 94 results in rotation of the rod 68 relative the extension 74.

The upper end 86 of the rod 68 includes a pronged fork generally designated 98. The fork 98 includes two prongs 100 and 102, respectively, which define an aperture 104 through which a bolt 106 extends. A first arm 108 is pivotally mounted relative the bolt 106 such that the arm 108 pivots about the bolt 106 between the two prongs 100 and 102. The arm 108 includes a first and a second end 110 and 112, respectively. A first primary bracket 114 is rigidly secured to arm 108 and extends in a plane substantially perpendicular to the plane of the arm 108. The first primary bracket 114 includes at the distal end thereof, a pair of pivot blocks 116 shown in FIG. 4 for rotatably supporting a pin 118 which extends through a plunger 120 of a suction cup second pneumatic ram 122. The casing of the ram 122 is pivotally connected to the distal end of the radius arm 78 such that actuation of the ram 122 results in the pivoting of the arm 108 relative the rod 68.

A first secondary bracket 124 extends perpendicularly from the second end 112 of the arm 108. The plane of the bracket 124 is tilted angularly relative the plane of the arm 108. The distal end of the bracket 124 defines a slot 126 for the reception of externally threaded tubes 128 and 128'. The tubes 128 and 128' are rigidly secured to the distal end of the bracket 124 by means of nuts which cooperate with the external threading of the tubes 128 and 128', respectively. The first ends of the tubes 128 and 128', respectively, are connected to flexible pipes 130 and 130', respectively, which communicate with a source of partial vacuum. The distal ends of the tubes 128 and 128', respectively, are inserted within the bases 132 and 132' of rubber first suction cups 134 and 134' such that when the pipes 130 and 130' are connected to the source of partial vacuum, the suction cups 134 and 134' form a suction against bag B' when the suction cups 134 and 134' contact the bag.

Bag Gripping Device

Figure 5:
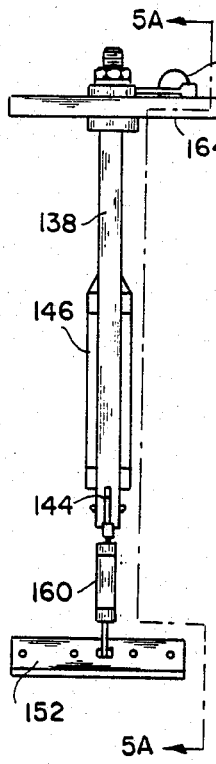
FIG. 5 is an enlarged elevational view of the bag gripping means shown in FIG. 1 showing the extension in an angular disposition.
Figure 5A:
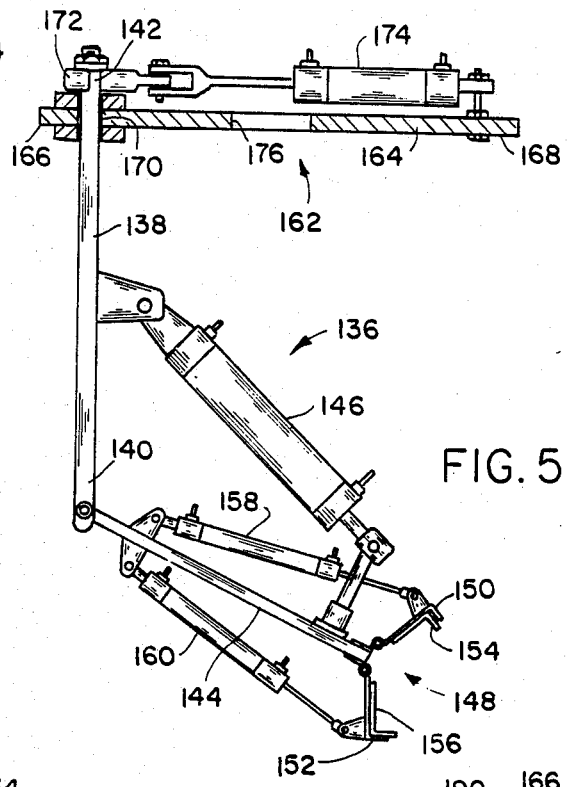
FIG. 5A is a sectional view taken on the line 5A—5A of FIG. 5 and shows the extension in an angular disposition and with the jaws pivoted to the opened position.

The bag gripping device is shown more particularly with reference to FIGS. 5, 5A, 28 and 29 and is generally designated 136. The bag gripping device 136 includes a rotatably shaft 138 having a first and a second end 140 and 142, respectively. An extension 144 is pivotally connected to the first end 140 of the shaft 138. A gripping device first ram 146 extends between and is pivotally connected to the shaft 138 and the extension 144 such that actuation of the ram 146 results in pivoting of the extension 144 relative the rotatable shaft 138. On actuation of the ram 146, the extension 144 moves from a first position in which the longitudinal axis of the extension 144 and the shaft 138 are the same as shown in FIGS. 28 and 29 to a second position in which the extension 144 is angularly disposed relative the shaft 138 as shown in FIG. 5.

A pair of gripping tongs generally designated 148 is pivotally connected to the distal end of the extension 144. The pair of tongs 148 include a first and a second jaw 150 and 152 having bag contacting liners 154 and 156 adjustably attached respectively, to the jaws 150 and 152. A gripping means second ram 158 extends between and is pivotally connected to the extension 144 and the first jaw 150. A gripping means third ram 160 extends between and is pivotally connected to the extension 144 and the second jaw 152. The rams 158 and 160 are disposed on opposite sides of the extension 144 such that actuation of the rams 158 and 160 results in the movement of the jaws 150 and 152 from a first position thereof in which the jaws 150 and 152 grip the opened valve vented bag B' as shown in FIG. 28 to a second position thereof in which the jaws 150 and 152 release the bag B' as shown in FIG. 29.

Bag Carriage

Figure 6:
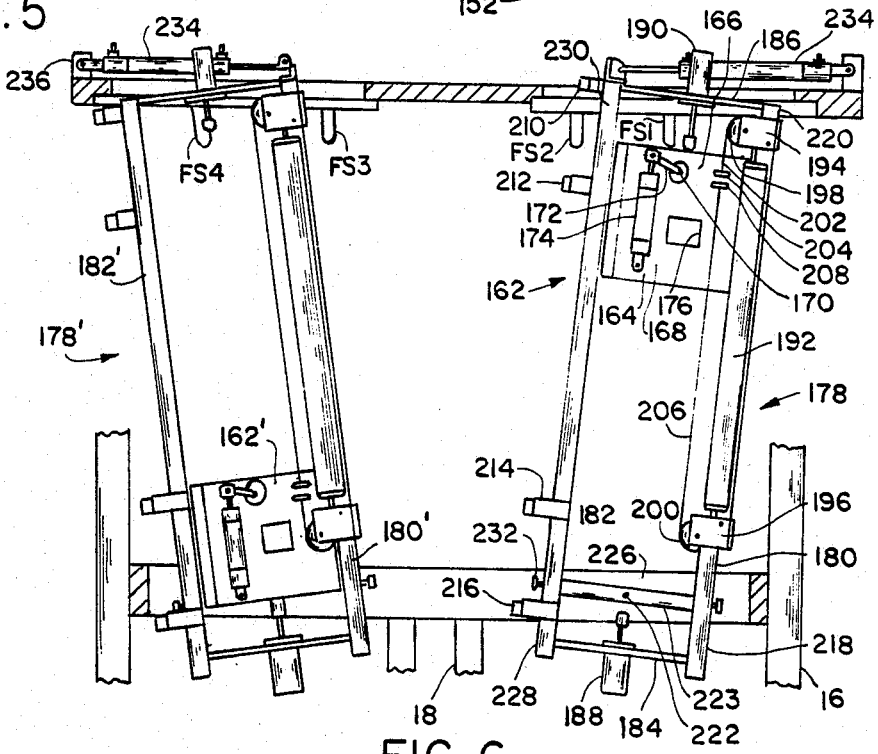
FIG. 6 is a top plan view of the automatic bag placer showing the first pair of rails disposed in the location for guiding the first carriage to the first filling spout and the second pair of rails disposed in the second location for guiding the second carriage to the fourth filling spout.

The bag carriage is shown more particularly with reference to FIGS. 5, 6 and 7 and is generally designated 162. The carriage 162 includes a thick plate 164 of an approximately square configuration. The plate 164 has a first and a second end 166 and 168, respectively. A central aperture 170 is defined by the plate 164 towards the first end 166 of the plate. The second end 142 of the rotatable shaft 138 extends through the aperture 170 such that the shaft 138 is rotatably supported by the carriage 162. A carriage radius arm 172 is rigidly secured to the second end 142 of the shaft 138 and the distal end of the arm 172 is pivotally connected to a carriage first ram 174 which is pivotally anchored adjacent the second end 168 of the plate 164 such that actuation of the ram 174 results in the rotation of the shaft 138 through a one-quarter revolution. The carriage 162 defines an orifice 176 disposed between the ends 166 and 168 for the passage therethrough of the various flexible pipes for the operation of the rams associated with the bag gripping device.

Rail Device

The rail device for supporting and guiding the carriage 162 is shown more particularly with reference to FIGS. 1, 6, 7, 25 and 26 and is generally designated 178. The rail device 178 includes a pair of rails 180 and 182 respectively, the rails 180 and 182 being spaced parallel relative each other by spacers 184 and 186. The carriage 162 slides between the rails 180 and 182 along the length of the rails between the spacers 184 and 186. A first carriage buffer 188 is secured centrally on the spacer 184 and a second carriage buffer 190 is secured centrally on the spacer 186 such that the buffers 188 and 190 arrest the movement of the carriage 162 along the length of the rails as the carriage 162 approaches the table 44 and the filling spout respectively.

The carriage 162 slides along the length of the rails by means of rollers (not shown) which engage a slot defined by the rails and is more fully described with reference to FIG. 25.

A first rail device ram 192 is disposed along the length of the rail 180 and rail brackets 194 and 196 are secured to the rail 180 at opposite ends of the ram 192. Each of the rail brackets 194 and 196 rotatably support a pulley 198 and 200 respectively. A first rail wire 202 is fastened to one end of a piston (not shown) that reciprocates within the ram 192. The wire 202 passes around the pulley 198 and is anchored to a first anchor bracket 204 secured to the top of the plate 164. A second rail wire 206 is anchored to the opposite end of the piston (not shown) and passes around the pulley 200 and is anchored to a second anchor bracket 208 also secured to the top of the plate 164. On actuation of the ram 192, the wires 202 and 206 cooperate to urge the carriage 162 along the length of the rails 180 and 182.

In addition to the buffers 188 and 190, carriage sensors 210 and 212 sense the approach of the carriage 162 towards the filling spout. Similarly, carriage sensors 214 and 216 sense the approach of the carriage 162 towards the table 44.

The rail 180 includes a first end 218 disposed towards the table 44 and a second end 220 disposed towards the filling spout of the packaging machine. As best shown with reference to FIGS. 6 and 25, a pivot pin 222 depends from a cross member 223 extending between the rails 180 and 182, respectively, and is engaged within an aperture 224 defined by an extension 226 of the framework 14 such that the rail device 178 pivots relative to the framework 14 to align the rail device 178 to guide the gripping device 136 towards the appropriate filling spout. The rail 182 includes a first and a second end 228 and 230 adjacent the table 44 and the filling spout respectively. Cantilevered rollers 232 are rotatably disposed on the first end 228 of each of the rails 182 and 180 and cooperate with the extension 226 to support the rail device.

A second ram 234 of the rail device 178 pivotally extends between the second end 230 of the rail 182 and an extension 236 of the framework 14 such that actuation of the second ram 234 pivots the rail device 178 from a first location as shown in FIG. 6 in which the gripper 136 is aligned with the first filling spout FS1 to a second location as shown in FIG. 7 in which the gripper 136 is aligned with the second filling spout FS2.

As shown in FIGS. 6, 7 and 27, the preferred embodiment of the present invention includes two rolls of bags, two conveyors, two tables, two clamps, two suction devices, two gripping devices, two carriages and two pairs rails. In order to avoid undue prolixity, FIGS. 6, 7 and 27 show the second roll, conveyor, table, clamp, suction device, gripping device, carriage and pair of rails with the designation 12', 24', 58', 60', 66', 136' and 178' respectively.

FIG. 25 is a sectional view taken on the line 25—25 of FIG. 7 and shows the rail 182' which defines a slot 238' which extends along the length of the rail 182'. The slot 238' receivably engages rollers (not shown) which protrude from the sides of the carriage 162'. The cross member 223' which extends between rails 180' and 182' includes a depending pivot pin 222' which is engaged within an aperture 224' of the extension 226.

A cantilevered roller bearing 233' is rotatably supported adjacent each end of the rails 180, 182, 180' and 182', respectively, such that the bearings 233' slide along horizontal support plates 235 and 235', respectively, as shown in FIGS. 6, 7, 25 and 26. The plates 235 and 235' are of a width sufficient to support the bearings 233' as they describe an arcuate path.

FIG. 26 is a sectional view of the rail 182' taken on the line 26—26 of FIG. 25 and showns the disposition therein of the slot 238'.

FIG. 26 also shows the roller bearing 233' depending from the rail 182' and supported by the horizontal support plate 235' shown in FIGS. 6 and 7.

As shown in FIGS. 6 and 7, the second pair of rails 178' pivot about pivot pin 222' to guide the second carriage 162' alternately between the filling spouts FS3 and FS4.

Operation of the Bag Placer

In operation of the bag placer of the present invention, reference is made particularly to FIGS. 8–24 which show the sequence in which various parts of the apparatus cooperate together to perform the required function.

FIG. 8 shows a bag B' being fed onto the table 44 by the conveyor 24. The bag clamps 58 and 60 are disposed in the upper position to allow the bag B' to move along the length of the table 44.

Figure 9:
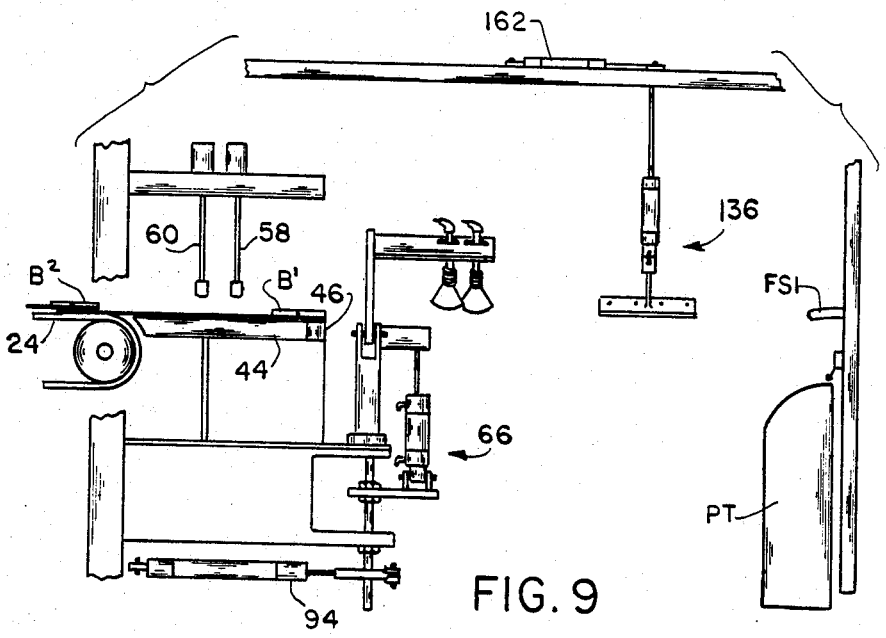
FIG. 9 is a similar view to that shown in FIG. 8 but with the bag being sensed by the bag sensor.

FIG. 9 shows the bag B' sensed by sensor 46 which sends a signal to actuate the clamps 58 and 60 to clamp the bag B' onto the table 44. A subsequent bag $B^2$ is fed by the conveyor 24 towards the table 44. However, when the sensor 46 senses the presence of bag B' a signal is also sent to the conveyor drive mechanism (not shown) to interrupt the further advance of bag $B^2$.

Figure 10:
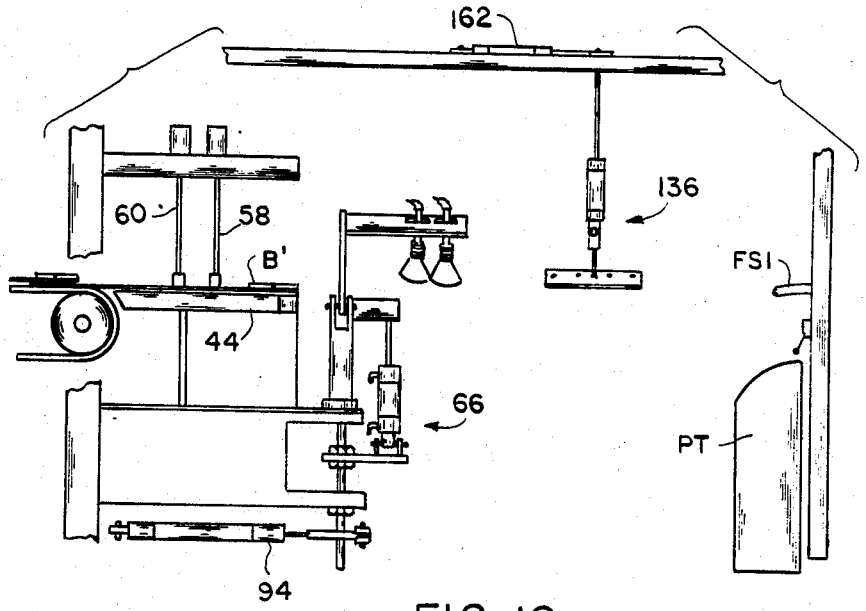
FIG. 10 is a similar view to that shown in FIG. 8 but shows the bag clamp lowered to clamp the bag against the table.

FIG. 10 shows the bag clamps 58 and 60 having clamped the bag B' to the table 44. The carriage 162 and gripping device 136 is shown advancing towards the table 44.

Figure 11:
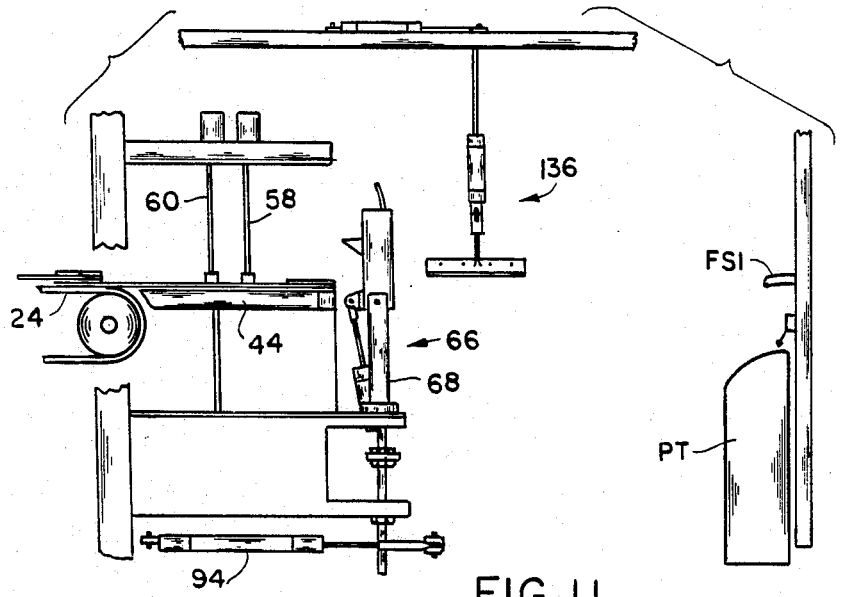
FIG. 11 is a similar view to that shown in FIG. 8 but shows the suction means having rotated to the second position thereof.

FIG. 11 shows the retractable suction device 66 having rotated a one-quarter revolution from a first position in which the suction device 66 is retracted as shown in FIGS. 8–10 to a second position. Rotation of the suction device 66 is carried out by actuating the ram 94 which pivots the rod 68 through a one-quarter revolution such that the suction cup 134 enters the pathway of the bags being advanced by the conveyor 24.

Figure 12:
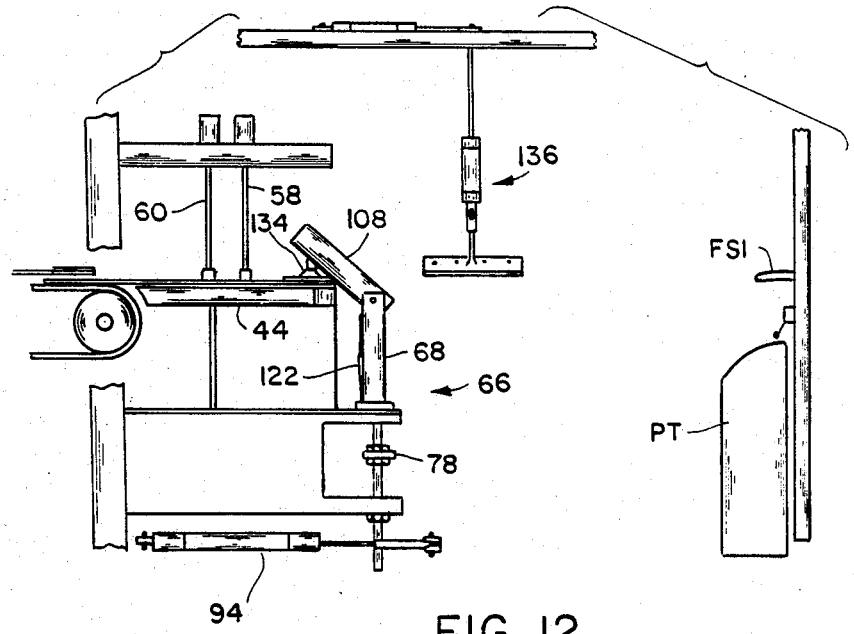
FIG. 12 is a similar view to that shown in FIG. 8 but shows the first arm of the suction means having pivoted to the third position such that the suction cup contacts the bag.

FIG. 12 shows the first arm 108 pivoted about the bolt 106 such that the suction cup 134 contacts the valve of the valve vented bag B'. Pivoting of the arm 108 is accomplished by the actuation of the ram 122 which pivots the arm 108 relative the rod 68. When the suction cup 134 is disposed in the third position as shown in FIG. 12, a partial vacuum is applied to the suction cup 134 which is in communication with the source of partial vacuum via pipe 130. The valve of the clamped bag B' is sucked against the suction cup 134 while the gripping device continues to approach the table 44.

Figure 13:
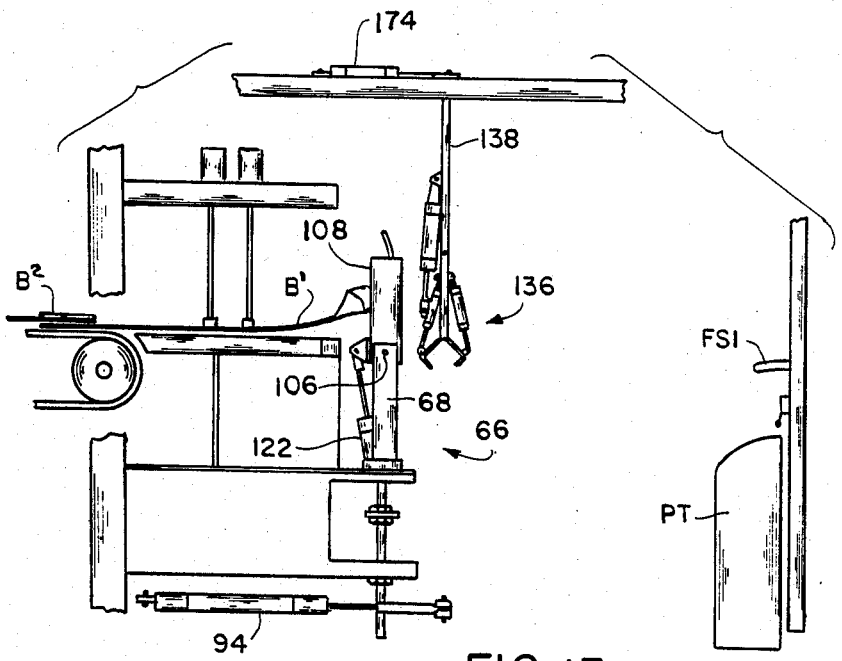

FIG. 13 shows the suction device 66 of the ram 122 having been activated to pivot the arm 108 to a fourth position of the suction device which is the same as the second position thereof. The partial vacuum is still maintained such that the valve of the valve vented bag B' is pulled away from the table 44 and is opened. During movement of the suction device from the third to the fourth position as shown in FIG. 13, the carriage first ram 174 is actuated to rotate the shaft 138 through a one-quarter revolution to align the gripping means 136 for gripping the bag B'.

FIG. 14 shows the suction device 66 still in the fourth position thereof with the vacuum applied to the suction cup 134. The ram 146 of the bag gripper is activated to tilt the gripping jaws into alignment with the opened bag B'. The rams 158 and 160 are also activated to pivot the jaws 150 and 152 to the open position to encircle the bag B'.

FIG. 15 shows rams 158 and 160 activated such that the jaws 150 and 152 close around the valve of the opened bag B'. When the jaws 150 and 152 have closed, the source of partial vacuum is disconnected from the suction cup 134.

FIG. 16 shows the ram 94 activated to rotate the rod 68 to the first position again retracted from the pathway of bags being fed along the table 44.

FIG. 17 shows the clamps 58 and 60 retracted to the upper position thereof to free the bag B' from the table 44.

FIG. 18 shows the carriage 162 returning towards the filling spout FS1. The ram 146 is activated to restore extension 144 to a dependent dispostion relative the shaft 138. The bag B' is being pulled off the table 44 and past the retracted suction device 66.

FIG. 19 shows the gripped bag with valve open depending from the gripping device 136. The subsequent bag $B^2$ is shown having been sensed by the sensor 46 and a further bag $B^3$ is approaching the table 44.

FIG. 20 shows the carriage ram 174 having been actuated to rotate the gripping device 136 and Bag B' through a one-quarter revolution such that the open valve of the bag B' is aligned for placement upon the filling spout FS1. Rotation of the bag B' is accomplished after the ram 192 as shown in FIGS. 6 and 7 has moved the carriage 162 towards the filling spout FS1.

Referring to FIGS. 6 and 7, the ram 192 is actuated to move the carriage 162 along the length of the rails 180 and 182. The ram 192 is connected to wires 202 and 206 which transmit the movement of the piston (not shown) of the ram 192 to the carriage 162.

As the piston (not shown) of the ram 192 slides with the ram 192, the wires which pass over the pulleys 198 and 200 pull the carriage towards either the buffer 188 or 190 in accordance with the direction of movement of the piston within the ram 192.

The location of the carriage 162 along the rails 180 and 182 is sensed by sensors 210 and 212 which send signals to the ram 192 to inhibit further movement of the carriage 162 against the buffer 190.

Sensors 214 and 216 similarly sense the approach of the carriage 162 relative to the buffer 188 and send signals to the ram 192 to reverse the direction of movement of the piston within the ram 192.

FIG. 21 shows the filling spout FS1 having entered into the open valve with the bag B'. A seensor device SD1 senses the presence of the bag B' and sends a signal to the rams 158 and 160 as shown in FIG. 28. The bag B' is filled with cement via filling spout FS1 and the weight of the filled bag is supported by a pivotable trough PT.

FIG. 22 shows the bag B' having been filled and the jaws 150 and 152 of the gripping device 136 being opened by actuation of the rams 158 and 160 in response to the signal received from the sensor SD1.

FIG. 29 is a sectional view taken on the line 29—29 of FIG. 22 and shows the gripping device 136 and bag B' being released from the gripping device.

FIG. 23 shows the gripping device 136 returning to the table 44 in order to grip the subsequent bag $B^2$.

FIG. 24 shows the filled bag B' supported by the pivotable trough PT pivoting away from the filling spout FS1.

The filled bag B' falls away from the filling spout FS1 onto a transverse conveyor generally designated TC and shown in FIGS. 1 and 27.

The sequence of operations as described hereinbefore is repeated relative to bag $B^2$. However, the ram 234 as shown in FIGS. 6 and 7 is actuated such that the pair of rails 178 is pivoted from the position shown in FIG. 6 to that shown in FIG. 7. In the position shown in FIG. 7, the gripped bag $B^2$ will be guided towards filling spout FS2 rather than filling spout FS1.

It will be apparent to those skilled in the art that the foregoing sequence can be continued to alternately place bags on filling spouts FS1 and FS2 respectively.

In a preferred embodiment of the present invention, the pairs of rails 178 and 178' can be operated independently of each other. However, if it is desired to fill bags from filling spouts FS1, FS2, FS3 and FS4 in a particular sequence, this may be accomplished by appropriate timing of the various operations.

While the second bag is being moved to the second filling spout, the first bag is still being filled. The time required to fill the first bag is approximately the same as that required for placing the second bag.

With reference to the sequence of operations of the various elements of the present invention, this may be accomplished by means of a computerized control circuit or any other suitable control device.

The bag placer of the present invention provides a self-contained unit for retrofitting to an existing bag packaging machine. The bag placer is fully automatic and provides a relatively inexpensive addition to a conventional packaging machine.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An apparatus for automatically opening valve vented bags and for transferring the opened bags from a bag conveyer and for placing the bag sequentially on filling spouts of a packaging machine, the apparatus comprising in combination:

a fixed framework;

first table means connected to said framework and disposed adjacent said bag conveyer for sequentially receiving said bags from said bag conveyer;

a first bag clamping means disposed adjacent said first table means for sequentially clamping said bag against said first table means;

a first retractable suction means cooperating with said valve vented bags for opening said clamped bags;

a first bag gripping means for gripping said opened bag;

a first carriage means for supporting said first bag gripping means; and a first rail means for supporting and guiding said first carriage means, said first rail means being pivotably secured to said framework such that said first carriage means is sequentially guided to a plurality of the filling spouts.

2. An apparatus as set forth in claim 1 wherein said first table means is disposed in the same plane as said valve vented bags being conveyed along said first bag conveyor.

3. An apparatus as set forth in claim 1 wherein said first table means further comprises a first bag sensing means for sensing the presence of a bag on said first table.

4. An apparatus as set forth in claim 1 wherein said first bag clamping means includes a plurality of first clamping means rams for sequentially pressing said bags against said first table means.

5. An apparatus as set forth in claim 4 wherein said plurality of first clamping means rams are spaced relative to each other and disposed obliquely relative to the direction in which said bags are fed along said bag conveyor.

6. An apparatus as set forth in claim 1 wherein said first bag gripping means includes a first shaft which rotatably depends from said first carriage means.

7. An apparatus as set forth in claim 6 wherein a first ram of said first carriage means is pivotally connected to and extends between said first carriage means and said first shaft for rotating said first shaft of sad first bag gripping means relative said first carriage means.

8. An apparatus as set forth in claim 7 wherein a first extension of said first bag gripping means first shaft is pivotally connected to a first end of said first bag gripping means first shaft and a first bag gripping means first ram pivotally extends between said first extension and said first bag gripping means first shaft for moving said first extension angularly relative said first shaft of said first gripping means.

9. An apparatus as set forth in claim 8 wherein a first and a second jaw of a pair of tongs are pivotally connected to a distal end of said first extension of said first gripping means.

10. An apparatus as set forth in claim 9 wherein a second ram of said first gripping means pivotally extends between said first jaw and said first extension of said first gripping means for pivoting said first jaw relative said first extension.

11. An apparatus as set forth in claim 10 wherein a third ram of said first gripping means pivotally extends between said second jaw and said first extension of said first gripping means for pivoting said second jaw relative said first extension such that said first and said second jaws cooperate together to grip an opened bag when held in said fourth position by said first retractable suction means.

12. An apparatus as set forth in claim 1 wherein said first carriage means slides along said first rail means.

13. An apparatus as set forth in claim 12 wherein a first ram of said first rail means is connected to said first carriage means to controllably move said first carriage means along said first rail means.

14. An apparatus as set forth in claim 13 wherein a first sensor means of said first rail means is disposed on said first rail means for sensing the approach of said first carriage means relative said open bag disposed in said fourth position of said suction means.

15. An apparatus as set forth in claim 14 wherein a second sensor means of said first rail means is disposed on said first rail means for sensing the approach of said first carriage means relative one of said filling spouts.

16. An apparatus as set forth in claim 1 wherein said first rail means comprises a first pair of parallel rails for slidingly supporting said first carriage means.

17. An apparatus for automatically opening valve vented bags and for transferring the opened bags from a bag conveyer and for placing the bag sequentially on filling spouts of a packaging machine, the apparatus comprising in combination:

a fixed framework;

a first retractable suction means connected to said framework and disposed adjacent the bag conveyer, said suction means cooperating with the valve venting bags for opening the bags;

a first bag gripping means for gripping said opened bags;

a first carriage means for supporting said first bag gripping means;

a first rail means for supporting and guiding said first carriage means, said first rail means being pivotably secured to said framework such that said first carriage means is sequentially guided to a plurality of said filling spouts.

18. An apparatus for automatically opening valve vented bags and for transferring the opened bags from a bag conveyor and for placing the bags sequentially on filling spouts of a packaging machine, the apparatus comprising in combination:

a first table means disposed adjacent said bag conveyor for sequentially receiving said bags from said bag conveyor;

a first bag clamping means disposed adjacent said first table means for sequentially clamping said bags against said first table means;

a first retractable suction means cooperating with said valve vented bags for opening said clamped bags;

said first retractable suction means further comprising:

a first rotatably mounted rod;

a first arm pivotally mounted to one end of said first rod;

a first primary bracket rigidly secured to said first arm, said first primary bracket being disposed in a plane substantially perpendicular to the plane of said first arm;

a first secondary bracket rigidly secured to said first arm remote from said first rod and said first primary bracket, said first secondary bracket being disposed in a plane substantially perpendicular to and tilted relative said plane of said first arm;

a first radius arm rigidly secured to said first rod;

a suction cup second ram pivotally connected to and extending between said first radius arm and said first primary bracket;

a suction cup first ram pivotally connected to said first rod for rotating said first rod about the axis thereof;

a first suction cup rigidly secured adjacent said first secondary bracket such that the combined operation of said first and said second suction cup rams causes respectively pivoting of said first arm relative said first rod and rotation of said first rod to advance said first suction cup towards said first table means;

a first bag gripping means for gripping said opened bags;

a first carriage means for supporting said first bag gripping means; and a first rail means for supporting and guiding said first carriage means, said first rail means being pivotally mounted such that said first carriage means is sequentially guided to a plurality of the filling spouts.

19. An apparatus a set forth in claim 18 wherein said first retractable suction means cooperates with said valve vented bags disposed on said first table means, said first suction means moving sequentially from a first position in which said first suction cup is retracted relative said first table means to a second position in which said first suction cup is disposed adjacent a clamped bag to a third position in which said first suction cup is connected to a source of partial vacuum and contacts said clamped bag adjacent said valve of said bag to a fourth position in which said first suction cup returns to said second position while connected to said source of partial pressure.

20. An apparatus as set forth in claim 19 wherein said first to said fourth positions of said first suction cup are repeated sequentially such that valve vented bags disposed on said first table means are sequentially opened.

21. An apparatus for automatically opening vented bags and for transferring the opened bags from a bag conveyer and for placing the bag sequentially on filling spouts of a packaging machine, the apparatus comprising in combination:

a first table means disposed adjacent said bag conveyer for sequentially receiving said bags from said bag conveyer;

a first bag clamping means disposed adjacent said first table means for sequentially clamping said bags against said first table means;

a first retractable suction means cooperating with said valve vented bags for opening said clamped bags;

a first bag gripping means for gripping said opened bags;

a first carriage means for supporting said first bag gripping means;

said bag gripping means further including:

a shaft rotatably secured relative said carriage means;

a first and a second end of said shaft;

an extension pivotally connected to said first end of said shaft;

a gripping means first ram extending between and pivotally connected to said shaft and said extension;

a pair of gripping tongs pivotally connected to said extension and disposed remote from said shaft;

a gripping means second and third ram extending between and pivotally connected to said extension and said pair of gripping tongs, said second and third rams being disposed on opposite sides of said extension;

a carriage means first ram extending between and pivotally secured to said carriage means and said rotatable shaft for rotating said gripping means relative said carriage means; and a first rail means for supporting and guiding said first carriage means, said first rail means being pivotably mounted such that said first carriage means is sequentially guided to a plurality of the filling spouts.

22. An apparatus for automatically opening vented bags and for transferring the opened bags from a bag conveyer and for placing the bag sequentially on filling spouts of a packaging machine, the apparatus comprising in combination:

a first table means disposed adjacent said bag conveyer for sequentially receiving said bags from said bag conveyer;

a first bag clamping means disposed adjacent said first table means for sequentially clamping said bags against said first table means;

a first retractable suction means cooperating with said valve vented bags for opening said clamped bags;

a first bag gripping means for gripping said opened bags;

a first carriage means for supporting said first bag gripping means;

a first rail means for supporting and guiding said first carriage means, said first rail means being pivotably mounted such that said first carriage means is sequentially guided to a plurality of the filling spouts;

said first rail means comprising a first pair of parallel rails for slidingly supporting said first carriage means, and said first pair of parallel rails being pivotally mounted relative first table means.

23. An apparatus as set forth in claim 22 wherein a second ram of said first rail means pivots said first pair of parallel rails from a first location of said first rail means in which said first carriage means is guided towards a first filling spout of a first plurality of said plurality of filling spouts to a second location of said first rail means in which said first carriage means is guided towards a second filling spout of said second plurality of filling spouts.

24. An apparatus as set forth in claim 23 wherein a second ram of a second rail means pivots a second pair of parallel rails from a first location of said second rail means in which a second carriage means is guided towards a third filling spout of a second plurality of said plurality of said filling spouts to a second location of said second rail means in which said second carriage means is guided towards a fourth filling spout of said second plurality of filling spouts.

25. An apparatus for automatically opening valve vented bags and for transferring said opened bags from a bag conveyor and for placing said bags sequentially on filling spouts of a packaging machine, said apparatus comprising in combination:

a framework;

a first bag conveyor;

a first and a second end of said bag conveyor, said first end of said first bag conveyor being pivotally mounted relative said framework;

a first roll of valve vented bags, said first roll being supported adjacent said second end of said first bag conveyor;

a first counterweighted pulley means cooperating with said second end of said first bag conveyor for counteracting the weight of said first roll and said first bag conveyor;

a first table means disposed adjacent said first end of said first bag conveyor;

a first bag clamping means disposed adjacent said first table means for sequentially clamping said bags against said first table means;

a first retractable suction means cooperating with said valve vented bags for opening said clamped bags;

a first bag gripping means for gripping said opened bags;

a first carriage means for rotatably supporting said first bag gripping means; and a first rail means for supporting and guiding said first carriage means, said first rail means being pivotally disposed on said framework such that said first carriage means is alternately guided to a plurality of said filling spouts.

26. An apparatus for automatically opening valve vented bags and for transferring said opened bags from a bag conveyor and for placing said bags sequentially on filling spouts of a packaging machine, said apparatus comprising in combination:

a framework;

a first and a second bag conveyor;

a first and a second end of each of said first and second bag conveyors, said first ends of said bag conveyors being pivotally mounted relative said framework;

a first and a second roll of valve vented bags, said first and said second rolls being respectively supported adjacent said second ends of said bag conveyors;

a first and a second counterweighted pulley means cooperating respectively with said second ends of said bag conveyors for counteracting respectively the weights of said first roll and first bag conveyor and said second roll and said second bag conveyor;

a first and a second table means disposed respectively adjacent said first ends of said first and said second bag conveyor;

a first and a second bag clamping means disposed respectively adjacent said first and said second table means for sequentially clamping said bags against said table means;

a first and a second retractable suction means cooperating with said valve vented bags of said first and said second rolls respectively, for opening said clamped bags, each of said suctions means moving sequentially from a first position in which each of said suctions means is retracted relative said respective table means to a second position in which each of said suction means is disposed adjacent a respective clamped bag to a third position in which each of said suction means is connected to a source of partial vacuum and contacts each of said clamped bags adjacent each of said valves of each of said bags to a fourth position in which each of said suction means returns to said second position while connected to said source of partial vacuum;

a first and a second bag gripping means for gripping said opened bags while held in said fourth position by said first and said second suction means, respectively;

a first and a second carriage means for rotatably supporting said first and said second bag gripping means, respectively; and a first and a second rail means for supporting and guiding said first and said second carriage means, respectively, said first and said second rail means each being pivotally mounted relative said framework such that said first carriage means is sequentially guided to a first plurality of said filling spouts and said second carriage means is sequentially guided to a second plurality of said filling spouts.

27. A method for automatically opening valve vented bags and for transferring said opened bags from a bag conveyor and for placing said bags sequentially on filling spouts of a packaging machine, said method comprising the steps of:

unwinding the roll of bags onto the bag conveyor;

moving the bags sequentially along the bag conveyor;

sequentially receiving the bags on the first table means;

sensing the presence of the bags when received on the first table means;

clamping the bags sequentially on the first table means;

rotating the first rotatably mounted rod from the first to the second position thereof;

pivoting the first arm to the third position thereof for bringing the first suction cup into contact with the valve of the clamped bag;

applying a partial vacuum to the first suction cup for forming a suction connection between the first suction cup and the valve of the clamped bag;

pivoting the first arm back to the fourth position thereof while the partial vacuum is still applied to the first suction cup for opening the valve of the clamped valve vented bag;

angularly tilting the first extension of the first gripping means during the approach of the first bag gripping means to the open bag;

pivoting the first and the second jaws away from each other such that the jaws encircle the opened valve of the valve vented bag held in the fourth position;

pivoting the first and the second jaws towards each other around the open valve of the valve vented bag held in the fourth position for gripping the open valve between the jaws;

releasing the source of partial vacuum from the first suction cup for releasing the first suction cup from the valve of the opened bag;

rotating the first rotatably mounted rod to the first position thereof such that the first suction cup is retracted from the clamped bag;

releasing the clamped bag from the clamped disposition on the first table;

operating the first ram of the first rail for moving the first carriage and connected jaws and gripped bag away from the first table;

operating the first ram of the first bag gripper for pivoting the first extension of the first bag gripper until the first extension and the first rod of the first bag gripper have the same longitudinal axis;

rotating the first rod of the first bag gripper through substantially a one-quarter revolution such that the opened valve of the bag is in alignment with the first filling spout;

continuing the movement of the first carriage towards the first filling spout until the first filling spout is inserted within the opened valve;

filling the bag from the first filling spout;

operating the second and third rams of the bag gripper to release the bag;

operating the first ram of the first rail for moving the first carriage away from the first filling spout;

permitting the filled bag to pivot away from the first filling spout;

rotating the first shaft of the first bag gripper back through substantially a one-quarter revolution such that the jaws are aligned for gripping a subsequently gripped bag; and repeating the foregoing steps with the first pair of rails pivoted to the second location thereof for guiding the first carriage towards the second filling spout.

* * * * *

UNITED STATES PATENT AND TRADEMARK OFFICE

CERTIFICATE OF CORRECTION

PATENT NO. : 4,548,243

DATED : October 22, 1985

INVENTOR(S) : Jose A. Diaz

It is certified that error appears in the above-identified patent and that said Letters Patent are hereby corrected as shown below:

In the Specification

Column 1, line 37, delete "onn" and insert therefore --on--.

Column 1, line 41, delete "spilling" and insert therefore --filling--.

Column 12, line 29, delete "seensor" and insert therefore --sensor--.

In the Claims

Claim 7, column 14, line 2, delete "sad" and insert therefore --said--.

Claim 19, column 15, line 50, delete "a" and insert therefore --as--.

Signed and Sealed this

*Thirty-first* Day of *December 1985*

[SEAL]

*Attest:*

DONALD J. QUIGG

*Attesting Officer*

*Commissioner of Patents and Trademarks*